US005769289A

United States Patent [19]

Lusk

[11] Patent Number: 5,769,289

[45] Date of Patent: Jun. 23, 1998

[54] DEVICE FOR AIDING IN DONNING OF GARMENTS

[76] Inventor: Robert A. Lusk, 1411 S. Wilson, Royal Oak, Mich. 48067

[21] Appl. No.: 783,500

[22] Filed: Jan. 14, 1997

Related U.S. Application Data

[63] Continuation of Ser. No. 370,266, Jan. 9, 1995, Pat. No. 5,593,071.

[51] Int. Cl.[6] ..... A47G 25/90

[52] U.S. Cl. ..... 223/112; 223/111

[58] Field of Search ..... 223/111, 112, 223/120, 116; 33/2 A, 3 A, 3 B, 3 C; D2/641, 642

[56] References Cited

U.S. PATENT DOCUMENTS

| | | | |
|---|---|---|---|
| D. 259,300 | 5/1981 | Vreeken . | |
| 1,297,500 | 3/1919 | Scharun | 33/33 B |
| 1,876,344 | 9/1932 | Pucunas | 223/77 |
| 2,601,131 | 6/1952 | Weber | 33/33 A |
| 2,840,285 | 6/1958 | Boruvka | 223/111 |
| 2,892,453 | 5/1959 | Zicarelli | 223/112 |
| 3,495,747 | 2/1970 | Saltiel . | |
| 4,541,554 | 9/1985 | Endress | 223/77 |
| 4,765,520 | 8/1988 | Barton | 223/11 |
| 4,942,988 | 7/1990 | Doorenbos . | |
| 5,050,783 | 9/1991 | Hunter . | |
| 5,082,154 | 1/1992 | French | 223/112 |
| 5,101,568 | 4/1992 | Ferragamo | 33/3 |
| 5,593,071 | 1/1997 | Lusk | 223/111 |

*Primary Examiner*—Bibhu Mohanty
*Attorney, Agent, or Firm*—Weintraub & Brady

[57] ABSTRACT

An aiding device for donning garments having a base and two stands mounted to the base. The stands are spatially positionable relative to each other to allow for a variety of garments to be mounted upon the stands. Additionally, at least one of the stands is rotatably mounted to the base to provide sufficient space for different size appendages to be inserted into the garment mounted upon the stands.

13 Claims, 1 Drawing Sheet

DEVICE FOR AIDING IN DONNING OF GARMENTS

This is a continuation, division, of application Ser. No. 08/370,266, filed Jan. 9, 1995, now U.S. Pat. No. 5,593,071.

BACKGROUND OF THE INVENTION

I. Field of the Invention

The present invention relates generally to devices for aiding in donning garments. More particularly, the present invention provides an adjustable device for aiding in donning garments. Even more particularly, the present invention concerns devices in assisting in the donning of socks by the user.

II. Prior Art

The problem of donning articles of clothing, such as socks and gloves, particularly for those people that are missing a hand, can be daunting. The process of stretching open a stocking, a mitten or a glove and pulling it onto an appendage is nearly an impossibility for a person who is missing a hand.

Many devices have been devised to aid people with the task of putting on stockings or hosiery, including the device disclosed in U.S. Pat. No. 5,050,783 to Hunter. Hunter teaches a device having first and second horseshoe-shaped elements and a compressible handle mounted to an extended hollow tube. The user attaches a stocking to the first horseshoe-shaped member and then presses the handle portion, engaging the two horseshoe-shaped members so as to hold the stocking in place. Use of this device is awkward and difficult for someone who is missing a hand. Additionally, this device fails to accommodate different size appendages. In essence, a person with a large calf muscle may not be able to use this device to place a sock over their foot and leg.

U.S. Pat. No. 4,942,988, issued Jul. 24, 1990 to Doorenbos teaches a device which aids a person in putting on elastic hose. This device is quite intricate and is not designed for use by someone having only one hand. Additionally, this device is not particularly adjustable.

U.S. Pat. No. 5,082,154, issued Jan. 21, 1992 to French discloses an apparatus for assisting an individual in donning hosiery. The apparatus includes a base member operatively attached to a three-legged hosiery support unit having two angled side supporting members and an angled rear support member which retains and expands the opening of an article of hosiery to accept the insertion of a user's foot. The three members of this apparatus are permanently attached to the base and are not adjustable. Therefore, this device is limited in its utility because people with large limbs are not able to use it to don hosiery, let alone other garments, such as mittens or gloves.

None of the devices of the prior art aid in the donning of different size garments with the use of only one hand. Additionally, no device cited in the prior art is substantially adjustable. It is to the solution of these problems which the present invention is directed.

SUMMARY OF THE INVENTION

The present invention provides an aiding device for donning garments comprising:

(a) a base;

(b) at least a pair of opposed stands, each of the at least a pair of stands disposed upon the base, each of the at least a pair of opposed stands comprising:

(1) a mounting portion mounted to the base;

(2) a garment receiving portion attached to the mounting portion; and wherein at least one of the at least a pair of stands is pivotally mounted to the base.

The base and the stands may be metal or other durable material. At least one of the stands may be pivoted between a vertical orientation and a substantially acute orientation relative to the base. Each stand may be extensible so that garments of differing sizes may be placed upon the stands.

The base may include a slide arm for adjusting the relative distance between the stands to accommodate varying size limbs. A user places a garment, i.e., a sock, glove, or mitten over each of the two stands and pulls it over each of the stands so that the garment encircles the outside of the stands. The garment is essentially turned inside out on the stands. The user then inserts the appropriate limb into the garment and pushes downwardly. The garment rides up the outside of the stands and onto the users appendage. The user then removes his or her limb and the garment from the stands by lifting the limb away from the stands.

The present invention will be more clearly understood with reference to the accompanying drawings and the following detailed description, in which like reference numerals refer to like parts and where:

DETAILED DESCRIPTION OF THE PREFERRED EMBODIMENT

Figure 1:
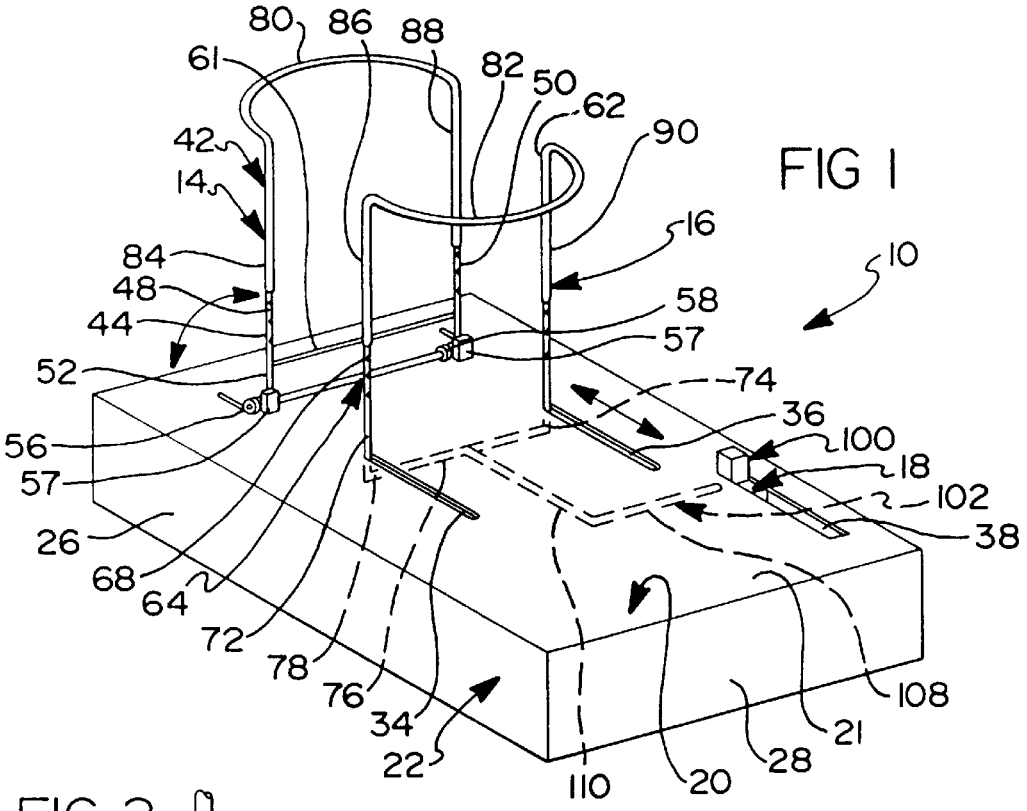
FIG. 1 is a perspective view of a preferred embodiment the present invention.
Figure 2:
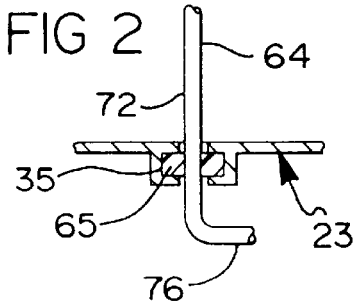
FIG. 2 is a view of a mounting portion of a stand taken along 2—2 of FIG. 1.

Referring now to FIGS. 1 and 2, an aiding device 10 for donning a garment is depicted as having a base 12, a first stand 14, a second, preferably slidably adjustable, stand 16 and means 18 for adjusting the position of the second stand 16 relative to the first stand 14.

The base 12 has a top portion 20 and a bottom portion 22 which cooperate to define a hollow interior. The interior is hollow to provide space for components which make the preferred embodiment slidably adjustable. The top portion 20 has an exterior surface 21 and an interior surface 23. The base may be made of metal, hard plastic, wood or any other durable, strong material known to the skilled artisan.

The bottom portion 22 includes a bottom wall (not shown) and four side walls, 26, 26', 28, 28', which are integrally formed, or attached to the bottom wall and to each other. Means for attaching the side walls 26, 26', 28, 28', to the bottom wall and to each other include gluing, welding, or any other suitable means known to the skilled artisan.

Substantially identical elongated slots 34, 36, 38 each oriented in parallel with the length of the top portion 20, are formed therein. The three slots 34, 36, 38 in the top portion 20 each have an associated C-channel 35, 37 39 formed at the interior surface 23 of the top portion 20. Each C-channel 35, 37, 39 lies directly below and extends the same length as its associated slots 34, 36, 38. Two of the slots 34, 36 are aligned side-by-side towards the center of the top portion. The third slot 38 is located towards one of the corners of the top portion 20. The slots cooperate with the second stand 16 and several other components to provide slidable adjustment of the second stand 16, as will be described herein.

Figure 3:
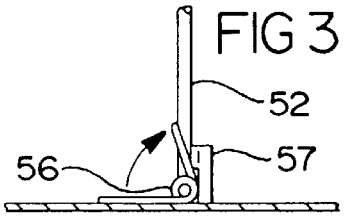
FIG. 3 is a side view of the mounting portion of a stand of the preferred embodiment herein.

Referring to FIGS. 1 and 3, the first stand 14 has a mounting portion 40 and a garment receiving portion 42. The mounting portion 40 comprises two substantially identical elongated rods 44, 46 having upper ends 48, 50 and lower ends 52, 54. The lower ends 52, 54 of the two substantially identical, elongated rods 44, 46 are hingedly mounted to the exterior surface 21 of the top portion 20 of the base 12. Spring-biased hinges 56, 58 pivotally join the lower ends 52, 54 of the two substantially identical rods 44, 46 to the base 12. The lower ends 52, 54 of the two substantially identical, elongated rods 44, 46 are housed within their corresponding spring biased hinges 56, 58 which are in turn mounted to the base 12. Means for mounting a spring biased hinge include gluing, welding or other means well known to the skilled artisan. Additionally, the two spring-biased hinges 56, 58 bias the first stand 14 towards a vertical orientation. Two stops 57, 59 retain the first stand in a vertical position, preventing the spring-biased hinges 56, 58 from biasing the first stand beyond a vertical orientation. Additionally, the two spring-biased hinges 56, 58 are preferably connected by a connecting-rod 61 which is integrally formed with and extends between the two hinges 56, 58. The connecting-rod 61 ensures that the elongated rods 44, 46 move uniformly so the first stand 14 does not bend or twist upon its use, increasing the life of the device 10.

Referring to FIGS. 1 and 2, the second stand 16 has a mounting portion 60 and a garment receiving portion 62. The mounting portion 60 comprises two substantially identical elongated rods 64, 66 having upper ends 68, 70 and lower ends 72, 73. The lower end 72 of one of the elongated rods 64 fits through its associated elongated aperture 34 and is slidably seated within the C-channel 35, in the top portion 20 of the base 12. The lower end 72 extends through a slide 65 housed within the C-channel 35 and into the hollow interior of the base 12. The slide 65 fits snugly about the lower end 72 of the rod 64. Additionally, the slide 65 fits snugly within the C-channel 35 frictionally holding the rod 64 in place. The slide 65 may be formed from hard rubber, plastic, metal, or other material which will securely hold the lower portion 72 of the rod 64 and slidably move within the C-channel 35.

Because both lower ends 72, 73 are substantially identical, only the relationship to other elements of lower end 72 is depicted in a separate Figure (FIG. 2). However, it is to be understood that lower end relates to other elements in an identical fashion to lower end 72, fitting through its associated aperture 36 and its corresponding slide 67 in the C-channel 37.

To provide slidable adjustment of the second stand 16, a connecting rod 76 having a first end 78 and a second end 74 is attached to and connects each of the two substantially identical elongated rods 64, 66. The first end 78 of the connecting rod 76 is attached to one of the two substantially identical elongated rods 64 at its lower end 72. The second end 74 of the connecting rod 76 is attached to the other substantially identical elongated rod 66 at its lower end 73. The connecting rod 76 is attached to the two substantially identical elongated rods 64, 66 where their lower ends 72, 74 protrude through the slides 65, 67 in the two C-channels 35, 37 in the top portion 20 of the base 12. Means for attaching the connecting rod 76 to the lower ends 72, 74 include welding, gluing or other means known to the skilled artisan. Additionally, the connecting rod may be integrally formed at the lower ends 72, 74.

The garment receiving portions 42, 62 of the first and second stands 14, 16 are substantially identical and are depicted in FIG. 1 as opposedly arranged arcuate rims 80 and 82 having first ends 84, 86 and second ends 88, 90. The present invention will function with many configurations for the upper portion including straight bars as opposed to arcuate rims 80, 82. Other configurations will be well known to the skilled artisan. Each end 84, 86, 88, 90 of the arcuate rims 80, 82 telescopingly house the corresponding upper ends 48, 50, 68, 70 of each rod 44, 46, 64, 66 of the mounting portions 40, 60 of each stand 14, 16.

The stands 14, 16 are, preferably, both extensible. In the preferred embodiment, each of the rods 44, 46, 64, 66 is telescopingly housed within each of the ends 84, 86, 88, 90 of the garment receiving portions. Each of the stands 14, 16 includes means for locking the stand 14, 16 in an extended position. Such means preferably include a plurality of spring biased detents 55, 55', 55", 55'" attached to the upper ends 48, 50, 68, 70 of rods 44, 46, 64, 66 of the mounting portions 40, 60. Other well known means for locking a telescoping rod in an elongated position may also be used. It is to be appreciated that the detents 54 are only necessary on one or two of the rods 44, 46, 64, 66; however, including the detents on all four rods increases the stability of the device.

The means for locking the stands 14, 16 into an extended position allow for graduated extension of the stands 14, 16 by raising the stands to expose one or more detents which were heretofore housed within the garment receiving portion. The stands 14, 16 may be returned to their retracted position by pressing the detents into their respective rods 44, 46, 64, 66 and pushing the garment receiving portions down over the mounting portions. Other means for extending elongated telescoping rods and temporarily maintaining their extended position are well known to the skilled artisan and include a latch and hook, or other similar means.

Figure 4:
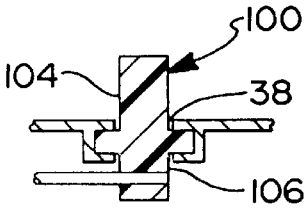
FIG. 4 is a view of the slide arm of the preferred embodiment herein.

FIGS. 1 and 4 depict the means for adjusting 18 the position of the second stand 16. The means for adjusting 18 includes a handle 100 and an L-shaped bar 102. The handle 100 has a grasping portion 104 and a lower portion 106 which passes through aperture 38 and which lies within and below the C-channel 39 in the top portion 20 of the base 12. The L-shaped bar 102 has a first end 108 and a second end 110.

Proximate its lower portion 106, the handle 100 is slidably housed within the C-channel 39. The grasping portion 104 protrudes up through the aperture 38 in the top 20 of the base 12.

The first end 108 of the L-shaped bar 102 is normally mounted to the lower portion 106 of the handle 100, and is parallel to the connecting rod 76. The second end 110 of the L-shaped bar 102, which is aligned normally to the first end 108 and the connecting rod 76 is medially mounted to the connecting rod 76.

A user may hold the grasping portion 104 of the handle 100 and laterally move the handle 100 having the second stand 16 move correspondingly. This allows the user to adjust the distance between the first stand 14 and the second stand 16 to accommodate different size garments and different size appendages, i.e., feet or hands.

Additionally, and although not shown, means for locking the handle 100 in place in the C-channel 39 can be included. Such means may include a hook and latch mechanism, where a series of latches are mounted to the top portion 20 at its exterior adjacent to the third aperture 38. The hook is included on the grasping portion 104 so that the hook may be placed into a latch locking the handle in place.

The present invention may be produced with a stationary second stand 16. However, it is advantageous to provide the adjustable second stand 16 in that the device is easier to use for people having varying sized limbs.

Figure 5:
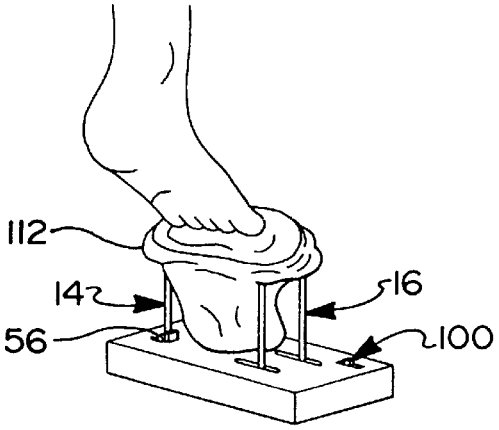
FIG. 5 is a perspective view of the preferred embodiment in use.

FIG. 5 depicts the aiding device 10 for donning garments in use with a sock 112 disposed upon the stands 14, 16. A user first positions the handle 100 so that the first stand 14 and the second stand 16 are close enough together so that the sock 112 may be fitted over each garment receiving portions 42, 62 until the sock 112 is turned inside out over the two stands. The user then moves the handle 100 to a position that enables him to fit his foot between the two stands 14, 16 and into the opening of the sock 112.

As the user inserts his foot into the sock 112, the first stand 14 begins to rotate on the hinges 56, 58 towards a more horizontal orientation in response to the larger leg portion, i.e., the calf, that is slid into the sock and between the two stands 14, 16.

The sock 112 rides up the stands and onto the user's foot. Once the user has completely inserted his foot and a portion of his leg, the sock 112 may be removed from the stands 14, 16 merely by lifting the leg and sock 112 vertically away from the stands 14, 16.

A modified embodiment of the present invention (although not shown) includes the two stands mounted to the base; however, the stand which is pivotally mounted to the base is not slidably adjustable. Rather, the stand is removably pivotally mounted via a spring-biased hinge which is screwed into the base. The screws may be removed and reinserted at different points along the base providing a small amount of adjustability. Screw holes are provided in the base so that the stand is provided with a discreet set of positions to which it may be attached to the base. The screws may have a finger portion which allows a user to removably mount the pivot stand to the base without using a screwdriver or the like. Screws with a finger portion are well known and as such are not further described herein.

While the invention has been illustrated and described in detail in the drawings and the foregoing description, the same to be considered as illustrative and not restrictive character, it being understood that only the preferred embodiment has been shown and described and that all changes and modifications that come within the spirit of the invention are desired to be protected.

Having thus described the present invention, what is claimed is:

1. An apparatus to assist an individual in donning a garment, the apparatus comprising:

(a) a base defining a substantially hollow interior, the base having at least one aperture formed therethrough;

(b) at least a pair of stands, the pair of stands cooperating to receive the garment, each of the at least a pair of stands comprising:

(1) a mounting portion attached to the base;

(2) a garment receiving portion attached to the mounting portion;

(c) means for laterally adjusting distance between the mounting portions of the at least a pair of stands, the means disposed partially within the base and projecting through the at least one aperture in the base, and wherein at least one of the at least a pair of stands is pivotably mounted to the base.

2. The apparatus of claim 1 further including means for telescopingly extending at least one of them at least a pair of stands.

3. The apparatus of claim 1 wherein the garment receiving portion of at least one of the at least a pair of stands comprises an arcuate rim.

4. The apparatus of claim 1 wherein the receiving portion of at least one of the at least a pair of stands comprises an arcuate rim.

5. The apparatus of claim 2 wherein the receiving portion of at least one of the at least a pair of stands comprises an arcuate rim.

6. The apparatus of claim 3 wherein the at least a pair of stands are substantially identical.

7. The apparatus of claim 6 wherein the at least a pair of stands are disposed in opposition to each other.

8. The apparatus of claim 2 wherein the at least a pair of stands are substantially identical.

9. The apparatus of claim 8 wherein the stands are disposed in opposition to each other.

10. The apparatus of claim 5 wherein the at least a pair of stands are substantially identical.

11. The apparatus of claim 10 wherein the at least a pair of stands are disposed in opposition to each other.

12. The apparatus of claim 1 wherein the means for laterally adjusting distance between the at least a pair of stands comprises:

(a) a handle slidably mounted to the base;

(b) a connecting rod mounted to the mounting portion of at least one of the at least a pair of stands;

(c) a substantially L-shaped bar having a first end and a second end, the first end of the bar mounted to the handle, the second end of the bar mounted to the connecting rod; and wherein lateral movement of the handle produces a substantially similar lateral movement of the at least one of the at least a pair of stands that are attached thereto.

13. The apparatus of claim 2 wherein the means for extending at least one of the at least a pair of stands further comprises means for locking the at least one stand in an elongated position.

* * * * *